United States Patent [19]

Schellens

[11] 4,051,831

[45] Oct. 4, 1977

[54] HEATING STOVE

[75] Inventor: Eugene Peter Schellens, Essex, Conn.

[73] Assignee: South Cove Corporation, Inc., Essex, Conn.

[21] Appl. No.: 609,712

[22] Filed: Sept. 2, 1975

[51] Int. Cl.[2] ..... F24B 5/04

[52] U.S. Cl. ..... 126/76; 126/217; 237/52

[58] Field of Search ..... 126/76, 58, 217, 60, 126/65, 103; 237/52; 122/494

[56] References Cited

U.S. PATENT DOCUMENTS

| | | | |
|---|---|---|---|
| 974,290 | 11/1910 | Merritt | 126/65 X |
| 995,705 | 6/1911 | Neel | 126/9 |
| 998,800 | 7/1911 | Quigley | 126/76 |
| 1,028,928 | 6/1912 | Broussard | 126/60 |
| 1,044,724 | 11/1912 | Atteberry | 126/76 |
| 1,214,131 | 1/1917 | Canterbury | 126/9 R |
| 1,297,183 | 3/1919 | Kinney | 126/65 |
| 2,352,567 | 6/1944 | Raulston | 126/58 |
| 3,196,842 | 7/1965 | Huge et al. | 122/494 X |

FOREIGN PATENT DOCUMENTS

| | | | |
|---|---|---|---|
| 128,863 | 7/1940 | Sweden | 126/65 |

*Primary Examiner*—William E. Wayner
*Assistant Examiner*—William E. Tapolcai, Jr.
*Attorney, Agent, or Firm*—Edwin T. Grimes

[57] ABSTRACT

A heating stove for burning woodlike organic material having a fire box for receiving material to be burned substantially centrally therein. The walls of the fire box are sealed to render it substantially air-tight. At least one substantially vertically aligned draft tube depends downwardly from the cover of the fire box into the interior thereof for receiving combustion air at substantially atmospheric conditions from the upper end thereof and directing a flow to impinge upon the hearth adjacent the material to be burned from above and substantially in a vertical direction. Flue means are mounted on the fire box above the material to be burned and in spaced relationship with respect to the draft tube for removing the products of combustion and maintaining the fire box at a pressure below atmospheric pressure.

8 Claims, 10 Drawing Figures

HEATING STOVE

This invention relates to heating stoves and, more particularly, to stoves for burning wood, sawdust and the like organic materials. Heating stoves constructed in accordance with the concept of this invention are particularly adapted, among many other possible uses, for domestic heating purposes.

While many different types of heating stoves have been used heretofore with reasonable success, my contribution to the art is a new heating stove which is an improvement over such prior art stoves, as will become apparent as the description proceeds. Heretofore, cast iron stoves, such as the well known Franklin stove, were particularly popular in the home heating field due to their aesthetic appearance, low cost, and ease of manufacture. However, they were inefficient in their consumption of fuel, and relatively dirty and inconvenient with respect to the removal of waste products, such as ash and cinder removal.

Applicant has discovered a novel combination of elements combined in such a way as to afford a very economical, efficient and practical solution of the difficulties involved in overcoming the foregoing problems. Thus, a feature of the present invention resides in the provision of a new and improved heating stove which employs a novel combustion system. Applicant's improved fuel economy is achieved by controlling the amount of air available to the combustion process. This is effected by virtue of the use of a substantially air-tight fire box structure, which is completely impractical with the prior art cast iron stoves, because pig iron cannot be cast economically with the high tolerances necessary to create an air-tight structure. As a result, Applicant's stove operates at a pressure less than atmospheric, which results in more complete ultimate combustion of the fuel, as well as less ash accumulation. Combustion air is introduced from the top of the fire box through one or more downwardly directed draft tubes, that can be closely controlled by regulator means. Thus, the only air available in the fire box is that which passes through the draft tube, as the structure is otherwise air-tight. The combustion air introduced through the draft tubes is supplied at pre-selected points and maximum velocity consistent with the draft available to produce a superior effect in control and efficiency of combustion. The unique down draft system of the present invention results in a fire that burns from the top down, and effectively burns all the fuel with little ash residue.

The invention provides, as another of its objectives, a stove of the character aforesaid, which may be installed in any room of the home, with or without a fireplace, in a cottage or in a camp, which operates in a simple and clean manner, which provides a source of emergency heat, which provides an even level of heat, and which can burn for a long period of time without refueling, such as overnight, for example.

As still other objects of my invention, I provide a new and improved heating stove which purges the accumulation of ash on the hearth, thereby providing little ash to carry away, which burns wood-like organic materials and thereby serves as a replacement for more expensive fuels, and which automatically builds up a protective layer of creosote inside the fire box.

In order to accomplish the desired results, I provide a new, improved heating stove characterized by the combination of a fire box for receiving material to be burned substantially centrally therein. The fire box includes sidewalls, bottom means connected towards the bottom of the side walls, and a cover mounted toward the upper end thereof, and means are provided for sealing the fire box so as to render it substantially air-tight. At least one substantially vertically aligned draft tube depends downwardly from the top of the fire box for receiving combustion air at substantially atmospheric conditions from the upper end thereof and directs a flow to impinge upon the hearth adjacent the material to be burned, from above and substantially in a vertical direction. Flue means are mounted on the fire box above the material to be burned and in spaced relationship with respect to the draft tube for removing the products of combustion and maintaining the fire box at a pressure below atmospheric pressure. Further, in one form thereof, my invention provides anti-warping means for minimizing warpage of the fire box during operation.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis of the designing of other structures for carrying out the purposes of the invention. It is important, therefore, that this disclosure be regarded as including such equivalent constructions as do not depart from the spirit and scope of the invention.

Several embodiments of the invention have been chosen for purposes of illustration and description and are shown in the accompanying drawings forming a part of the specification, wherein.

Figure 1:
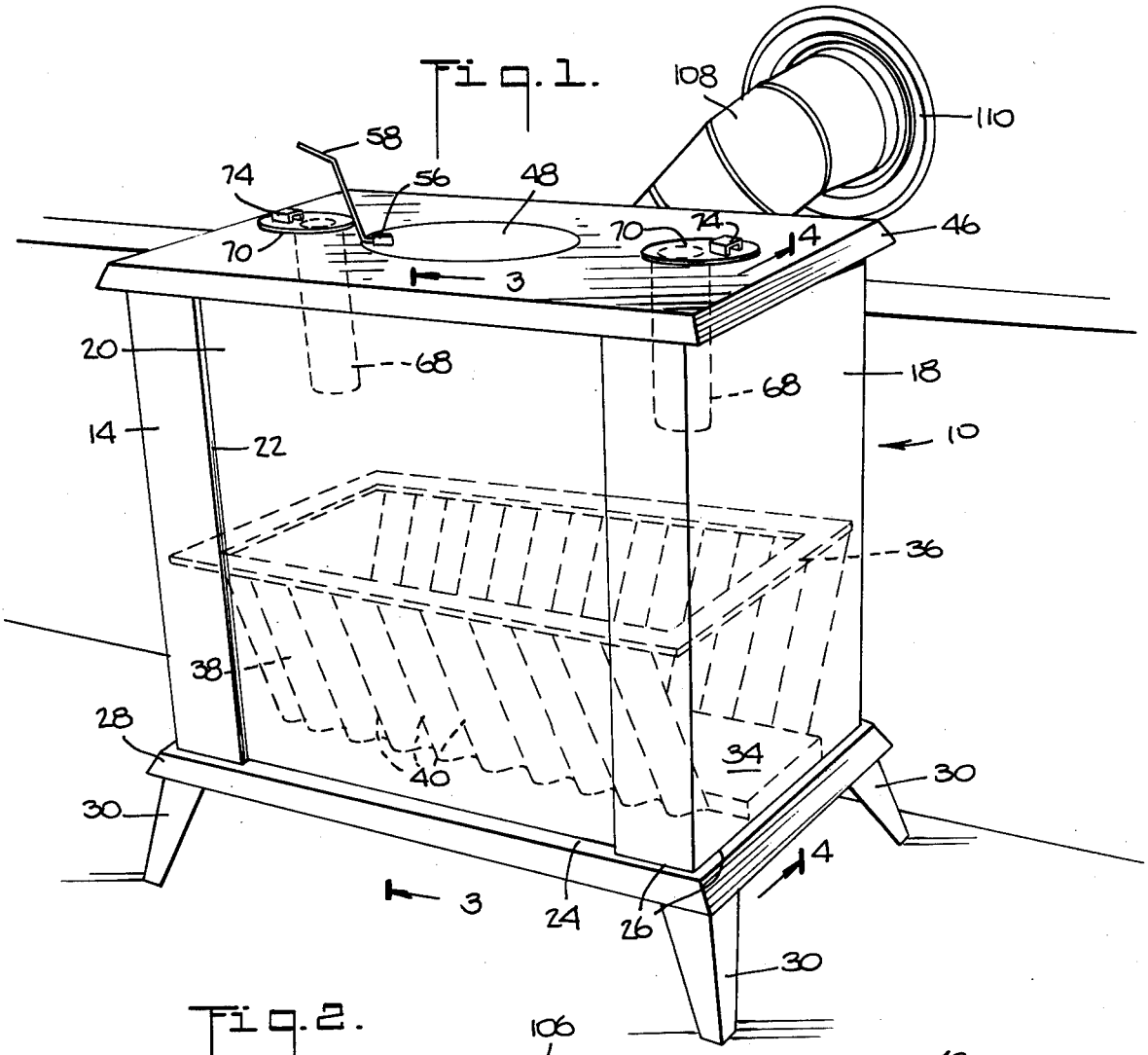
FIG. 1 is a perspective view of a heating stove constructed in accordance with the concept of this invention.
Figure 2:
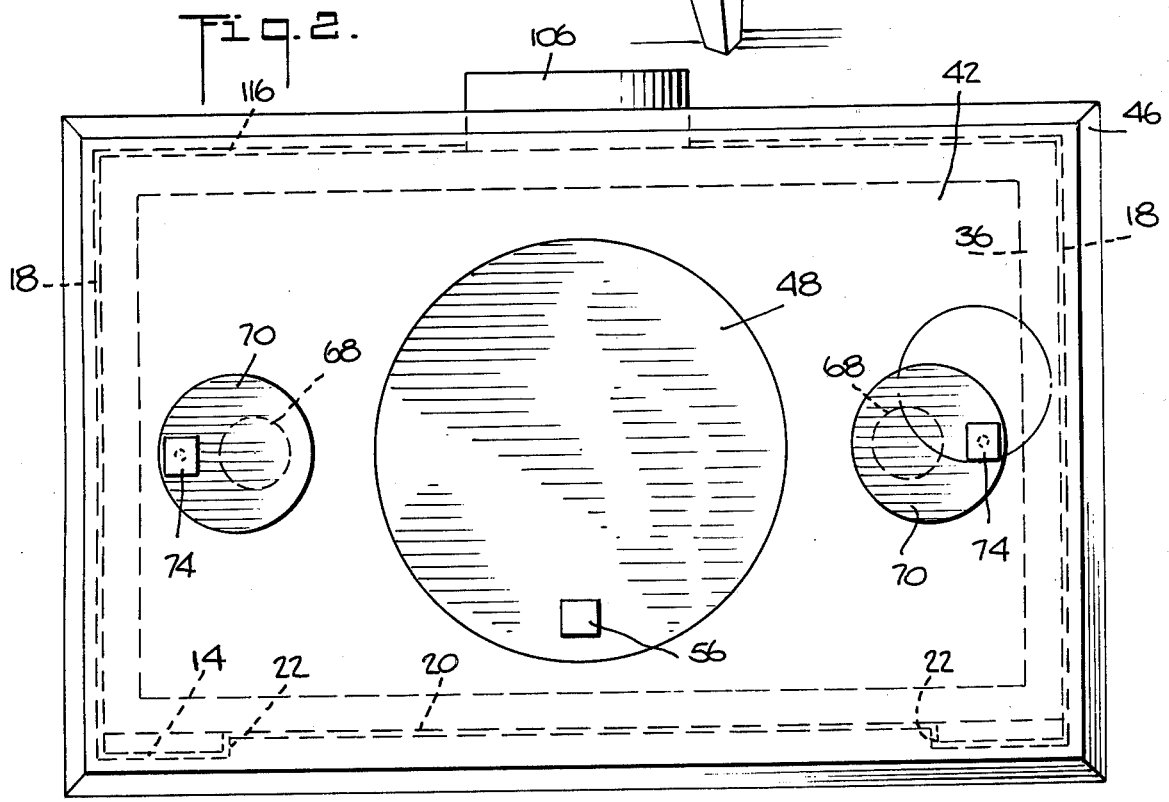
FIG. 2 is a plan view of the stove of FIG. 1.
Figure 4:
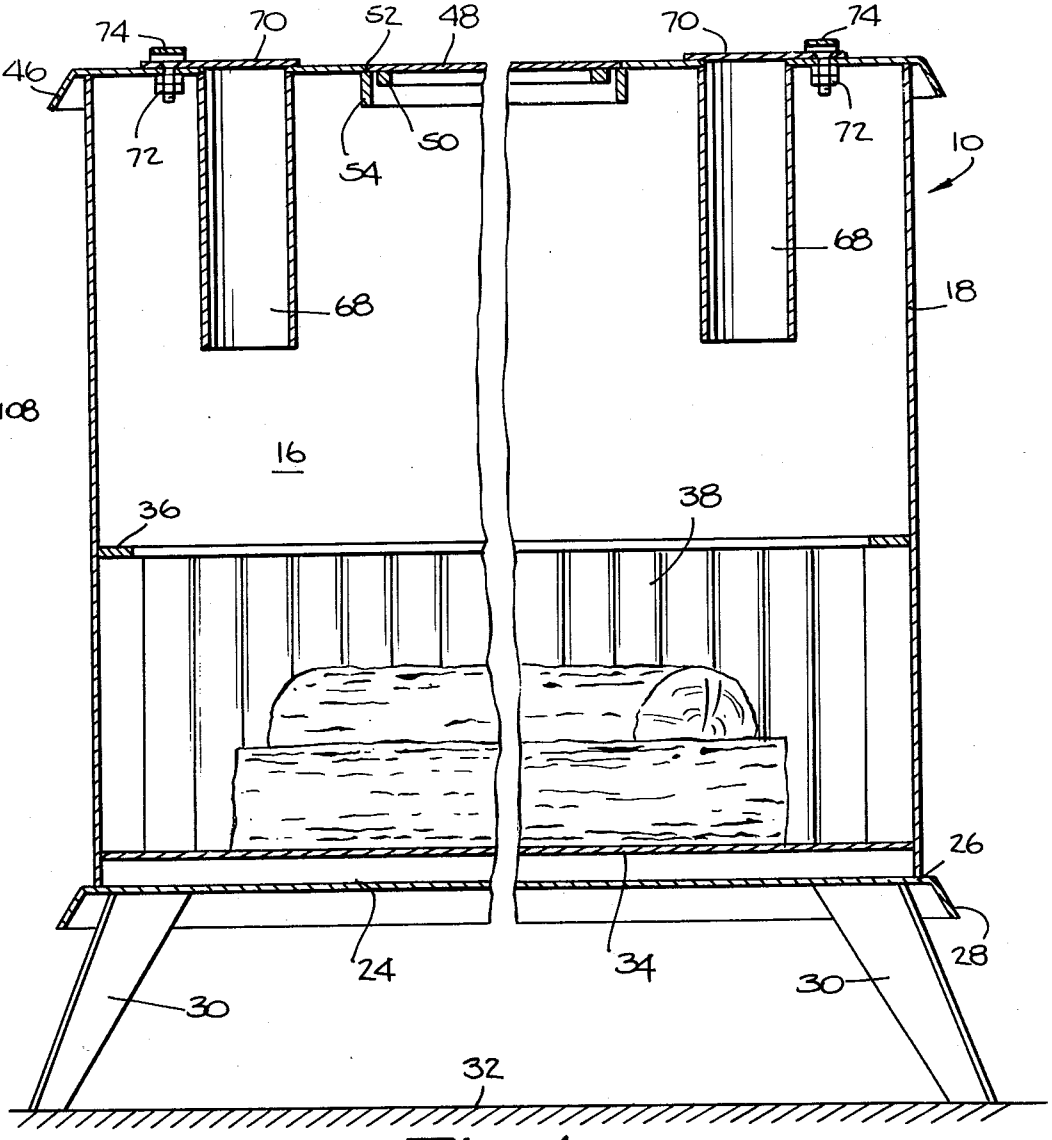
FIG. 4 is a vertical sectional view taken along the line indicated at 4—4 in FIG. 1.
Figure 3:
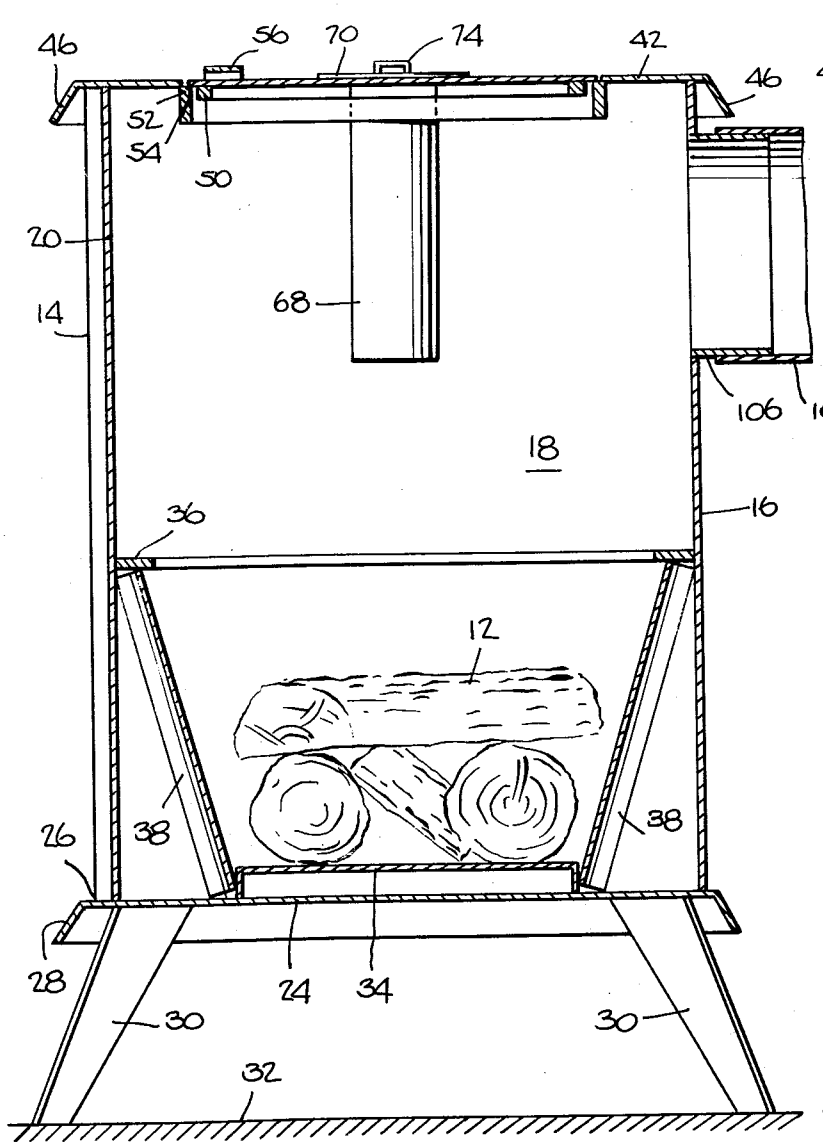
FIG. 3 is a vertical sectional view taken along the line indicated at 3—3 in FIG. 1.

In the embodiment of the invention illustrated in FIGS. 1 to 6, the heating stove includes a fire box, indicated generally at 10, for receiving logs or other wood-like organic material 12, FIGS. 3 and 4, to be burned substantially centrally therein. The fire box includes a front wall 14, a back wall 16, and two end walls 18. These walls may be fabricated from one or more pieces, but they must be interconnected, respectively, in sealed relationship such as by a continuous weld along their mating edges. As best seen in FIGS. 1 and 2, the front wall 14 has an enlarged central portion thereof recessed, as at 20 for purposes of assisting in preventing the fire box from warping during operation. That is, the front wall is recessed inwardly about one-half inch along vertically extending bend lines 22 from the top to the bottom, and about 3½ inches inwardly from the edges, respectively, for example.

Referring in particular to FIGS. 3 and 4, a bottom member 24 is fixedly connected to the bottom edges of the walls, as by means of a continuous weld, indicated at 26, to effect a complete seal. The bottom member 24 has a downwardly extending, slightly angularly disposed, apron 28, extending around the entire periphery thereof, for purposes of strengthening the member and assisting in the prevention of warpage of the fire box. The apron extends downwardly a distance of the order of about one inch, for example. Legs 30 are fixedly mounted on the bottom 24 to raise the entire fire box off the floor 32, in a conventional manner.

Still referring to FIG. 3, a U-shaped hearth-plate 34 is medially mounted on the bottom 24 and extends from the end wall to the other end wall of the fire box, for supporting the logs 12 in a slightly elevated position with respect to the bottom member.

About mid-way up the walls of the fire box, there is an inwardly projecting rib, or stiffener, which extends around the entire periphery of the fire box. This rib is fixedly attached to the walls as by means of tack welding, for example. This rib is an important element in preventing the fire box from warping during operation. Preferably, the rib is about one inch wide and has a thickness of about one/fourth inch. A pair of renewable fire box liners 38 extend from one end wall to the other end wall of the fire box, respectively. Each liner is angularly disposed with respect to the bottom so that it extends upwardly and outwardly from adjacent the hearth plate 34, to the peripheral rib 36. The liners may have a corrugated-like configuration, as indicated at 40 in FIG. 1, and are tack welded in position. These members also serve to support the logs 12 in their burning position and also help prevent warpage of the fire box during operation.

The top of the fire box 10 is enclosed by means of a cover 42, which is fixedly connected to the top edges of the walls, as my means of a continuous weld 44, FIGS. 3 and 4, to effect a complete seal of the fire box. The cover 42 is provided with a downwardly, outwardly angled apron 46 that contributes to the prevention of fire box warpage, and also presents a pleasing appearance.

A removable center lid 48 is centrally disposed in the cover 42 for purposes of providing access to the interior of the fire box. This is where the logs are added and the ash is removed. The lid is provided with an annular, downwardly extending ring 50 disposed a short distance inwardly of the outer periphery thereof to present an outer peripheral lip portion 52. The cover is provided with an opening for receiving the lid and an annular downwardly directed projection 54 surrounds the opening with a portion of its upwardly facing surface exposed to engage the lip portion 52, thereby to support the lid and form a relatively tight seal therewith. As shown in FIG. 1, a U-shaped strap 56 is mounted on the upper surface of the lid for receiving the end of a lid lifter 58 so that the lid may be readily removed or replaced, as desired.

Figure 9:
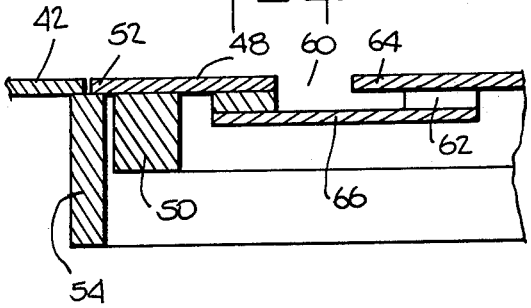
FIG. 9 is an enlarged fragmentary sectional view showing another form of lifting means for the center lid, according to my invention.

In FIG. 9, there is illustrated another form of lifting means for the lid 48. In this embodiment, the lid 48 is provided with a square-shaped aperture 60, and an inner spacer member 62, having an opening therein of larger area than the area of the aperture 60, is mounted under the aperture, but in an off-set relation with respect thereto, thereby to provide a lip portion 64. An inner member 66 serves as a bottom closure for the opening in the spacer member and thereby maintains the fire box in a sealed condition. For purposes of removing or replacing the lid 48, the end of the lid lifter 58 is inserted in the aperture 60 and lodged under the lip 64 to thereby serve as a handle. In this embodiment, the entire upper surface of the lid 48 is flush with respect to the cover 42, which makes it more convenient to place articles on top of the stove, as well as improving the appearance.

Figure 5:
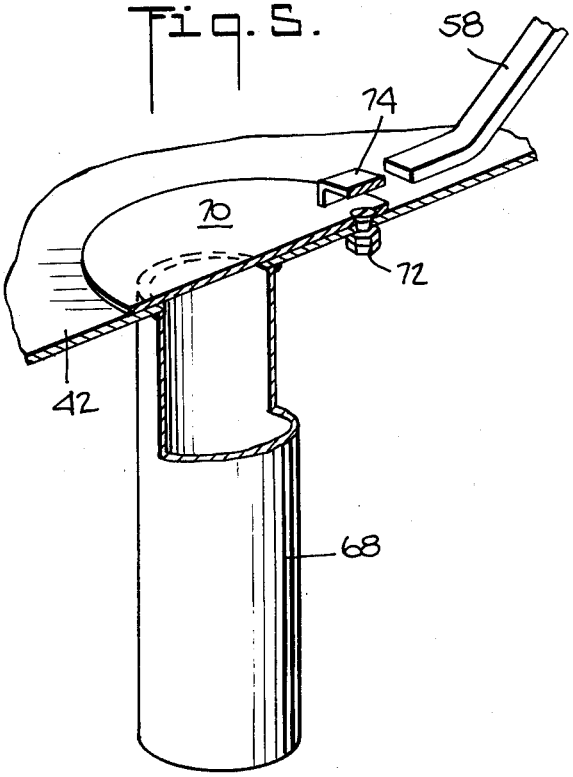
FIG. 5 is an enlarged fragmentary perspective view showing the draft control means, wherein the draft control disc is in a closed position.
Figure 6:
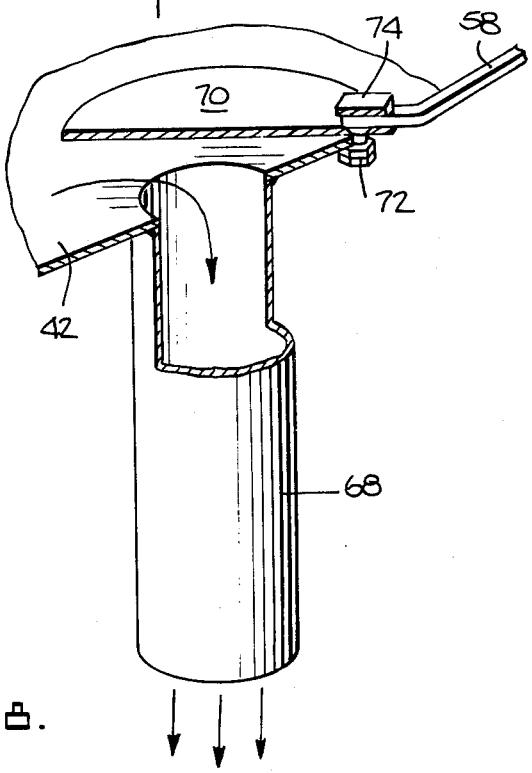
FIG. 6 is an enlarged fragmentary perspective view similar to FIG. 5, but showing the draft control disc in its open position.

The combustion air is supplied to the fire box by means of two, substantially vertically disposed nozzles or draft tubes 68. Each of these draft tubes are of the order of about 2 inches in diameter and extend downwardly from the cover 42 a distance of about 7½ inches, the lower ends thereof being of the order of about 20 inches above the hearth plate 34, for example. As best seen in FIGS. 5 and 6, regulator means are provided for controlling the flow of combustion air in each of the draft tubes. Thus, for each draft tube a draft control disc is provided mounted on the cover 42, as by means of a machine screw and nut 72, for example. A U-shaped strap 74 is mounted on the draft control disc 70 for receiving the end of the lid lifter 58, which when inserted therein serves as a handle for pivoting the disc. As a result, the draft control disc 70 may be pivoted to its closed position, as illustrated in FIG. 5, or to its open position as illustrated in FIG. 6, as well as to any intermediate position therebetween, as desired.

Figure 8:
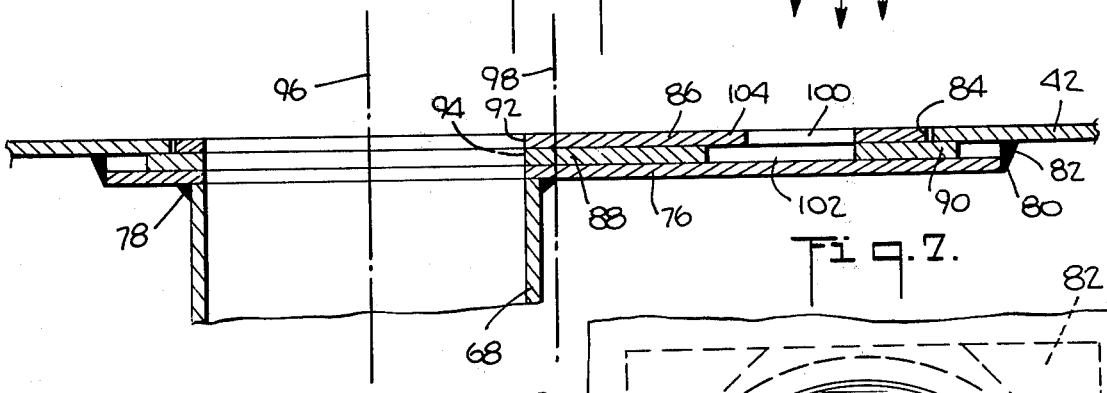
FIG. 8 is an enlarged vertical sectional view taken along the line indicated at 8—8 in FIG. 7.
Figure 7:
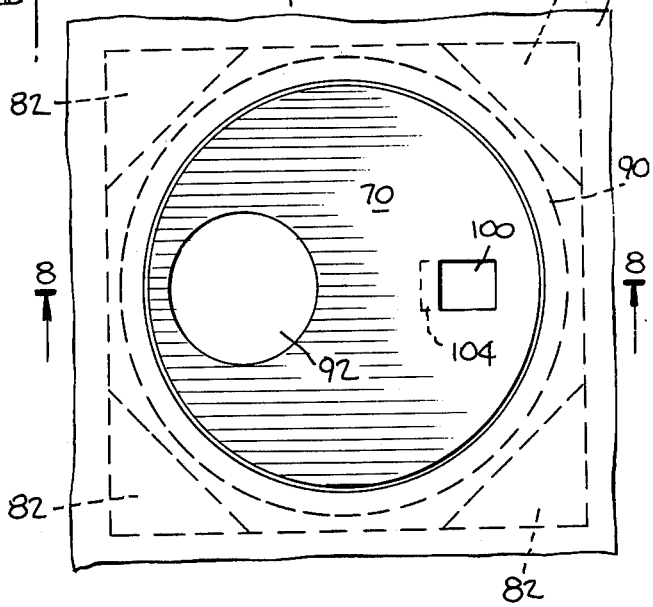
FIG. 7 is an enlarged plan view showing another form of draft control means according to the invention.

In FIGS. 7 and 8, there is illustrated another form of regulator means for the draft tubes 68, which comprises a supporting disc 76, having an aperture therein for receiving the open upper end of the draft tube. The draft tube is fixedly mounted on the disc 76 as by means of welding, as indicated at 78, and the periphery of the disc is fixedly mounted on the cover 42 as by means of welding, as indicated at 80. The support disc may either be provided with an outer peripheral upwardly extending flange, or spacers 82 may be employed. However, the outer periphery thereof must be in sealed relationship with respect to the cover 42. The cover 42 is provided with an opening 84 which receives an outer draft control disc 86. An inner draft control disc 88 is fixedly connected to the outer disc and has a larger outside diameter as compared to the outside diameter of the outer disc, to thereby form a lip portion 90 which engages the lower surface of the cover 42 to retain both discs in position. The outer disc 86 is provided with an opening 92 and the inner disc 88 is provided with an opening 94, which are in alignment with each other and are of a diameter substantially equal to the diameter of the draft tube 68. The centerline 96 of the draft tube 68 is off-set with respect to the centerline 98 of the inner and outer disc 88 and 86, so that when the two discs are rotated they cover various portions of the opening in the top of the draft tube, from full open to full closed, depending on the extent of rotation. Thus, the flow of combustion air entering the draft tube 68 is closely regulated or controlled by the degree of rotation of the discs 86 and 88. To facilitate the rotation of the discs, outer disc 86 is provided with a square-shaped aperture 100, and an inner disc 88 is provided with a rectangularly-shaped aperture 102, which is slightly larger than the aperture 100, to provide a lip portion 104 so that the end of the lid lifter 58 may be inserted through the aperture 100 and lodged under the lip portion to serve as a handle for rotating the disc. It will be appreciated that in this embodiment, the draft control disc is flush with respect to the fire box cover 42, which makes it more convenient to place articles on top of the stove, as well as improving the appearance thereof.

Reverting to FIGS. 1 and 3, the back wall 16 of the fire box is provided with a flue collar 106 that is located above the material to be burned and in spaced relationship with respect to the draft tubes, for removing the products of combustion and maintaining the fire box at a pressure below atmospheric pressure. A stove pipe 108, FIG. 1, is connected to the collar 106 and leads to a chimney flue opening 110. It is noted that there is no draft damper or key in this line. Preferably, the chimney extends at least about 16 feet above the fire box outlet to provide suitable draft.

Figure 10:
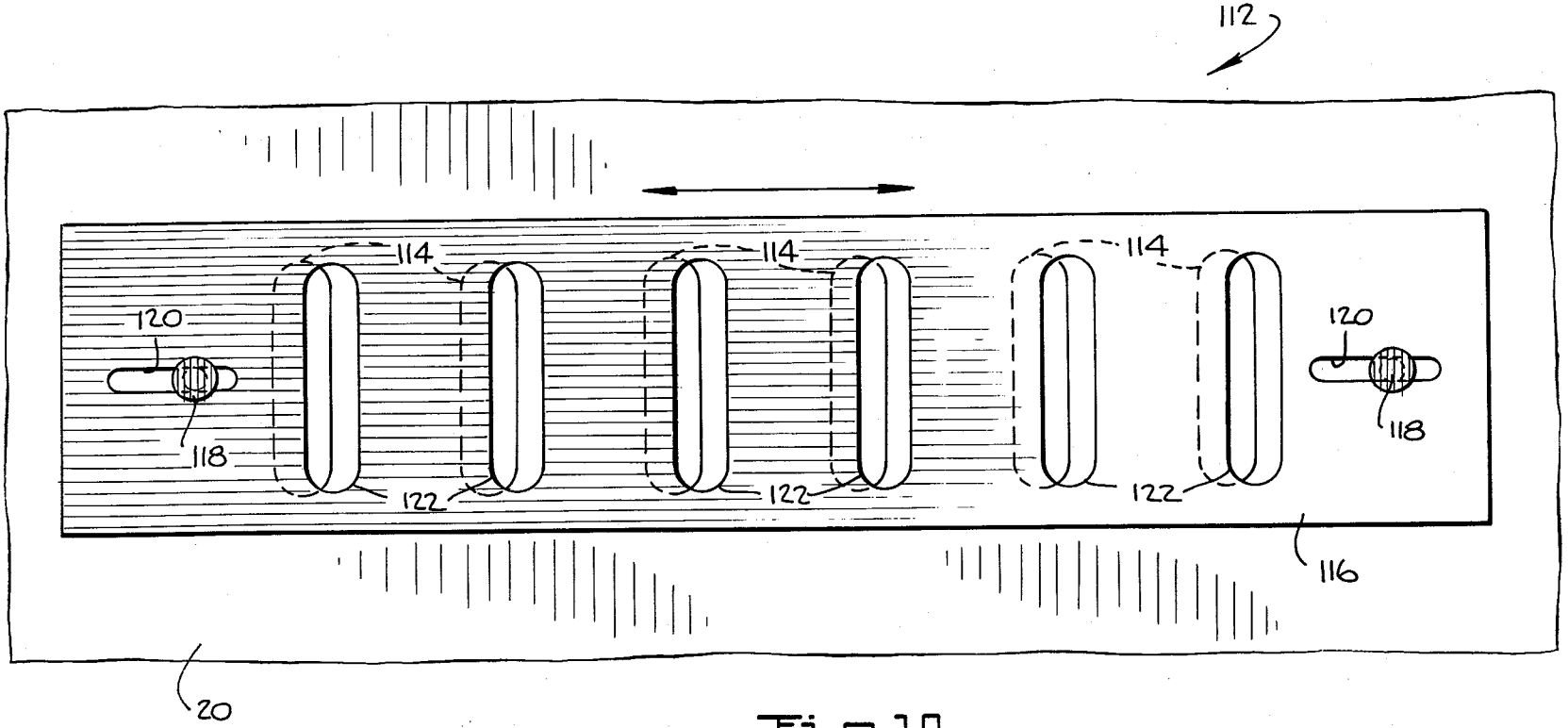
FIG. 10 is an enlarged side elevation showing means for controlling the flow of secondary air to the upper portion of the fire box.

In some installations it is desirable to provide secondary cooling air to the upper portion of the fire box 10. This is effected by virtue of the provision of an adjustable grill-like assembly in the upper central area of the recessed portion 20 of the front wall 14, as indicated generally at 112 in FIG. 10. The grill-like assembly includes a plurality of horizontally spaced slots 114, which are vertically elongated, in the recessed portion 20. A plate 116 is mounted for sliding horizontal movement on the recessed portion, as by means of pins 118 fitted in slots 120. The inner ends of the pins 118 have enlarged portions in order to retain the plate 116 snugly against the recessed portion 20. The plate 116 is provided with a like plurality of horizontally spaced slots 122, which are also vertically elongated and are of substantially the same size and configuration as the slots 114. In operation, the plate 116 is horizontally slideable so that when it is moved as far as possible to the left, as viewed in FIG. 10, the slots 122 are in alignment with the slots 114, thereby providing maximum flow of the cooling secondary air into the upper portion of the fire box 10. When the plate 116 is moved as far as possible to the right, as viewed in FIG. 10, the slots 122 are out of alignment with the slots 114 so that there is no flow of air into the fire box. Further, the operator can select any intermediate position for the plate 116, thereby to control the flow of secondary air, as desired.

Preferably, the walls, cover and bottom are fabricated from sheet steel and the draft tubes are fabricated from black iron continuous welded pipe.

In operation, three or more logs are inserted through the center lid 48 and placed lenghwise on the hearth plate 34, preferably between the draft tubes, so that the top of the logs come about to the top of the fire box liners 38. Then, a small amount of kindling is placed on top of the logs and several sheets of wadded-up newspaper are placed on top of the kindling under each draft tube. Both draft control discs are opened wide and the paper is lighted under each draft tube. The center lid is then replaced and the fire commences. Ignition of the wood takes from about 5 to about 15 minutes, and as the fire becomes established, the draft control discs are gradually closed. Additional logs may be added directly on top of the existing coals, as required. Once the logs become throughly ignited, very little air is required to keep the fire burning. Thus, the logs burn fully, and slowly, and hence the fuel consumption is very modest. It has been found that with good dry hard wood, a fire can last 24 hours without requiring additional fuel. During operation, the inside of the fire box is maintained at a pressure below atmospheric pressure due to the action of the flue system, in view of the fact that the fire box is substantially air-tight. The combustion air flows downwardly through the draft tubes so that the air, at substantially maximum velocity, impinges downwardly against whatever ashes that have settled below the logs. Thence, the air, which has been deflected along the plane of the hearth, passes through the interstices between the logs. It then converges generally upwardly at the center and is blown out the flue opening. The maintaining of maximum air velocity along the ash bed serves to keep the fly-ash in suspension on its way to the chimney. Thus, the relatively high velocity air jet clears itself due to the air always impinging on the fuel bed from above and, as a result, hand-removal of the ash is relatively infrequent, such as once or twice during the heating season, for example.

It will thus be seen that the present invention does indeed provide an improved heating stove which is superior in simplicity, operability, reliability, economy and efficiency as compared to prior art such stoves.

Although certain particular embodiments of the invention are herein disclosed for purposes of explanation, various modifications thereof, after a study of the specification, will be apparent to those skilled in the art to which the invention pertains.

What is claimed and desired to be secured by letters patent is:

1. A heating stove for wood-like organic material comprising, in combination, a fire box for receiving material to be burned substantially centrally therein, said fire box including sidewalls, bottom means connected towards the bottom of the sidewalls, and a cover mounted towards the upper ends of the sidewalls, and means for sealing the fire box so as to render it substantially air-tight, means for providing access to the interior of said fire box, at least one substantially vertically aligned draft tube depending downwardly from said cover into the fire box for receiving combustion air at substantially atmospheric conditions from the upper end thereof and directing a flow to impinge upon the hearth adjacent the material to be burned from above and substantially in a vertical direction, flue means mounted on the fire box above the material to be burned and in spaced relationship with respect to the draft tube for removing the products of combustion and maintaining the fire box at a pressure below atmospheric pressure, regulator means for regulating the flow of combustion air in said draft tube, said regulator means for the draft tubes comprising a support disc having an aperture therein for receiving the open upper end of the draft tubes, said draft tubes being fixedly mounted on said supporting disc, said supporting disc being fixedly mounted on said cover, said cover having an opening, an outer draft control disc, said cover having an opening for receiving said outer draft control disc, an inner draft control disc fixedly connected to the outer draft control disc and having a greater outside diameter with respect to the outside diameter of said outer disc to thereby form a lip portion which engages the lower surface of the cover to retain said discs in position with respect to said cover, said outer disc having an opening and said inner disc having an opening which are in alignment with each other and are of a diameter substantially equal to the diameter of said draft tube, the center line of the draft tube being off-set with respect to the center line of the inner and outer discs so that when said discs are rotated they progressively cover the opening in the top of the draft tube corresponding to the extent of rotation.

2. A heating stove for burning wood-like organic material according to claim 1, wherein said outer disc has a substantially square-shaped aperture and said inner disc has an aligned substantially rectangularly-shaped aperture having a larger area than said square-shaped aperture to provide a handle receiving lip portion.

3. A heating stove for burning wood-like organic material comprising, in combination, a fire box for receiving material to be burned substantially centrally therein, said fire box including sidewalls, bottom means connected towards the bottom of the sidewalls, and a cover mounted towards the upper ends of the sidewalls, and means for sealing the fire box so as to render it substantially air-tight, means for providing access to the interior of said fire box, at least one substantially vertically aligned draft tube depending downwardly from said cover into the fire box for receiving combustion air at substantially atmospheric conditions from the upper end thereof and directing a flow to impinge upon the hearth adjacent the material to be burned from above and substantially in a vertical direction, said hearth being a solid member to thereby prevent the flow of air therethrough, the portion of said fire box below the material to be burned being sealed to prevent the inflow of combustion air and the outflow of the products of combustion during operation of the stove, flue means on the fire box above the material to be burned and in spaced relationship with respect to the draft tube for removing the products of combustion and maintaining the fire box at a pressure below atmospheric pressure, and anti-warping means for preventing warpage of the fire box during operation, said anti-warping means comprising an inwardly projecting rib extending around the entire periphery of the fire box substantially medially of the height of said walls.

4. A heating stove for burning wood-like organic material comprising, in combination, a fire box for receiving material to be burned substantially centrally therein, said fire box including sidewalls, bottom means connected towards the bottom of the sidewalls, and a cover mounted towards the upper ends of the sidewalls, and means for sealing the fire box so as to render it substantially air-tight, means for providing access to the interior of said fire box, at least one substantially vertically aligned draft tube depending downwardly from said cover into the fire box for receiving combustion air at substantially atmospheric conditions from the upper end thereof and directing flow to impinge upon the hearth adjacent the material to be burned from above and substantially in a vertical direction, flue means mounted on the fire box above the material to be burned and in spaced relationship with respect to the draft tube for removing the products of combustion and maintaining the fire box at a pressure below atmospheric pressure, anti-warping means for preventing warpage of the fire box during operation, said anti-warping means comprising an inwardly projecting rib extending around the entire periphery of the fire box substantially medially of the height of said walls, and said anti-warping means further comprising a welded seam interconnecting said cover and said side walls.

5. A heating stove for burning wood-like organic material comprising, in combination, a fire box for receiving material to be burned substantially centrally therein, said fire box including sidewalls, bottom means connected towards the bottom of the sidewalls, and a cover mounted towards the upper ends of the sidewalls, and means for sealing the fire box so as to render it substantially air-tight, means for providing access to the interior of said fire box, at least one substantially vertically aligned draft tube depending downwardly from said cover into the fire box for receiving combustion air at substantially atmospheric conditions from the upper end thereof and directing a flow to impinge upon the hearth adjacent the material to be burned from above and substantially in a vertical direction, flue means mounted on the fire box above the material to be burned and in spaced relationship with respect to the draft tube for removing the products of combustion and maintaining the fire box at a pressure below atmospheric pressure, anti-warping means for preventing warpage of the fire box during operation, said anti-warping means comprising an inwardly projecting rib extending around the entire periphery of the fire box substantially medially of the height of said walls, said side walls comprising a front wall, a back wall and two end walls, said walls being interconnected in sealed relationship respectively, and said anti-warping means further comprising an enlarged recess in the central portion of said front wall, and said bottom member having a downwardly extending outwardly angled apron portion extending around the periphery thereof, and said cover having a downwardly extending outwardly angled apron portion extending around the periphery thereof.

6. A heating stove for burning wood-like organic material comprising, in combination, a fire box for receiving material to be burned substantially centrally therein, said fire box including sidewalls, bottom means connected towards the bottom of the sidewalls, and a cover mounted towards the upper ends of the sidewalls, and means for sealing the fire box so as to render it substantially air-tight, means for providing access to the interior of said fire box, at least one substantially vertically aligned draft tube depending downwardly from said cover into the fire box for receiving combustion air at substantially atmospheric conditions from the upper end thereof and directing a flow to impinge upon the hearth adjacent the material to be burned from above and substantially in a vertical direction, flue means mounted on the fire box above the material to be burned and in spaced relationship with respect to the draft tube for removing the products of combustion and maintaining the fire box at a pressure below atmospheric pressure, said means for providing access to the interior of said fire box comprising a removable lid centrally disposed in the cover, said lid having an annular downwardly extending ring disposed a short distance inwardly of the outer periphery thereof, to provide an outer peripheral lip portion, said cover having an opening for receiving said lid and an annular downwardly extending projection surrounding the opening with a portion of its upwardly facing surface exposed to engage said lip portion, thereby to support said lid in flush relationship with respect to said cover, said lid being provided with a square-shaped aperture, an inner spacer member having an opening therein of larger area than the area of said aperture, mounted under said aperture in off-set relationship with respect thereto to provide a handle receiving lip portion, an inner member mounted on said inner spacer to provide a bottom closure of the opening in the spacer member to thereby maintain the fire box in a sealed condition.

7. A heating stove for burning wood-like organic material comprising, in combination, a fire box for receiving material to be burned substantially centrally therein, said fire box having a front wall, a back wall, and two end walls, said walls being interconnected in sealed relationship respectively, a bottom member fixedly connected to the bottom edges of said walls in sealed relationship with respect thereto, a hearth plate medially mounted on the bottom and extending between the end walls for supporting the material to be burned in an elevated position with respect to the bottom member, an inwardly projecting rib extending around the entire periphery of the fire box substantially centrally of said walls at a location substantially above said hearth plate, a pair of fire box liners, each extending between the end walls and each being angularly disposed with respect to the bottom to extend upwardly and outwardly from the bottom adjacent said hearth plate to said inwardly projecting rib, a cover mounted towards the upper ends of the walls in sealed relationship with respect thereto, a removable center lid centrally disposed in the cover for providing access to the interior of the fire box, two spaced substantially vertically disposed draft tubes extending downwardly from the cover, each of said draft tubes having a draft control disc mounted on the cover for selectively, progressively covering the open upper end of said draft tube, a flue collar mounted on said back wall above the material to be burned and in spaced relationship with respect to said draft tubes for removing the products of combustion and maintaining said fire box at a pressure below atmospheric pressure.

8. A heating stove for burning wood-like organic material comprising, in combination, a fire box for receiving material to be burned substantially centrally therein, said fire box having a front wall, a back wall, and two end walls, said walls being interconnected in sealed relationship respectively, said front wall having an enlarged central portion thereof recessed, a bottom member fixedly connected to the bottom edges of said walls in sealed relationship with respect thereto, said bottom member having a downwardly extending outwardly angled apron portion extending around the periphery thereof, a plurality of legs fixedly mounted on the bottom, a U-shaped hearth plate medially mounted on the bottom and extending from one end wall to the other end wall of the fire box for supporting the material to be burned in an elevated position with respect to the bottom member, an inwardly projecting rib extending around the entire periphery of the fire box substantially centrally vertically of said walls, a pair of fire box liners, each extending from one end wall to the other end wall of the fire box and each being angularly disposed with respect to the bottom member to extend upwardly and outwardly from the bottom member adjacent said hearth plate to said inwardly projecting rib, a cover mounted towards the upper ends of the walls in sealed relationship with respect thereto, said cover being provided with a downwardly, outwardly angled apron portion extending around the periphery thereof, a removable lid centrally disposed in the cover for providing access to the interior of the fire box, said lid having an annular downwardly extending ring disposed a short distance inwardly of the outer periphery thereof to provide an outer peripheral lip portion, said cover having an opening for receiving said lid and an annular downwardly extending projection surrounding the opening with a portion of its upwardly facing surface exposed to engage said lip portion, thereby to support the lid, a U-shaped strap mounted on the upper surface of said lid for receiving handle means, two spaced substantially vertically disposed draft tubes extending downwardly from the cover, each of said draft tubes having an open upper end and a draft control disc pivotally mounted on the cover for selectively, progressively covering the open upper end, a U-shaped strap mounted on the upper surface of said draft control disc for receiving handle means, a flue collar mounted on said back wall above the material to be burned and in spaced relationship with respect to said draft tubes for removing the products of combustion and maintaining said fire box at a pressure below atmospheric pressure.

* * * * *